US007497663B2

(12) United States Patent
McRae, Jr. et al.

(10) Patent No.: US 7,497,663 B2
(45) Date of Patent: Mar. 3, 2009

(54) ROTOR BLADE PROFILE OPTIMIZATION

(75) Inventors: Ronald Eugene McRae, Jr., Cincinnati, OH (US); Brian David Keith, Cincinnati, OH (US); Andrew Edward Obermeyer, West Chester, OH (US); Leslie Eugene Leeke, Burlington, KY (US)

(73) Assignee: General Electric Company, Schenectady, NY (US)

( * ) Notice: Subject to any disclaimer, the term of this patent is extended or adjusted under 35 U.S.C. 154(b) by 357 days.

(21) Appl. No.: 11/586,952

(22) Filed: Oct. 26, 2006

(65) Prior Publication Data

US 2008/0101959 A1 May 1, 2008

(51) Int. Cl.
*F01D 5/14* (2006.01)

(52) U.S. Cl. ..... 416/191; 416/223 A; 416/DIG. 2; 416/243

(58) Field of Classification Search ..... 416/191, 416/243, 223 A, DIG. 2, DIG. 5
See application file for complete search history.

(56) References Cited

U.S. PATENT DOCUMENTS

| | | | | |
|---|---|---|---|---|
| 4,970,871 | A | 11/1990 | Rudick | |
| 6,183,198 | B1 | 2/2001 | Manning et al. | |
| 6,327,867 | B1 | 12/2001 | Hyodo et al. | |
| 6,398,489 | B1 | 6/2002 | Burdgick et al. | |
| 6,450,770 | B1 * | 9/2002 | Wang et al. | 416/223 A |
| 6,558,122 | B1 | 5/2003 | Xu et al. | |
| 6,607,355 | B2 | 8/2003 | Cunha et al. | |
| 6,722,853 | B1 | 4/2004 | Humanchuk et al. | |
| 6,739,839 | B1 | 5/2004 | Brown et al. | |
| 6,769,878 | B1 * | 8/2004 | Parker et al. | 416/243 |
| 6,779,977 | B2 * | 8/2004 | Lagrange et al. | 416/223 A |
| 6,779,980 | B1 * | 8/2004 | Brittingham et al. | 416/243 |
| 6,854,961 | B2 * | 2/2005 | Zhang et al. | 416/223 A |
| 6,887,041 | B2 | 5/2005 | Coke et al. | |
| 6,923,623 | B2 * | 8/2005 | Cleveland et al. | 416/97 R |
| 7,094,034 | B2 | 8/2006 | Fukuda et al. | |
| 2004/0057833 | A1 * | 3/2004 | Arness et al. | 416/243 |
| 2004/0115058 | A1 * | 6/2004 | Lagrange et al. | 416/223 A |
| 2004/0241002 | A1 * | 12/2004 | Zhang et al. | 416/223 A |
| 2005/0013695 | A1 * | 1/2005 | Hyde et al. | 416/243 |
| 2006/0024168 | A1 * | 2/2006 | Fukuda et al. | 416/223 R |
| 2006/0073014 | A1 * | 4/2006 | Tomberg et al. | 416/96 R |

* cited by examiner

*Primary Examiner*—Edward Look
*Assistant Examiner*—Dwayne J White
(74) *Attorney, Agent, or Firm*—William Scott Andes, Esq.; Armstrong Teasdale LLP

(57) ABSTRACT

An airfoil for a rotor blade including an uncoated profile substantially in accordance with Cartesian coordinate values of X, Y and Z to facilitate balancing performance and durability of the rotor blade and to facilitate improving an operating efficiency of a high-pressure turbine is provided. The profile is carried only to four decimal places, wherein Y represents a distance from a platform on which the airfoil is mounted, and X and Z are coordinates defining the profile at each distance Y from the platform.

20 Claims, 5 Drawing Sheets

ROTOR BLADE PROFILE OPTIMIZATION

BACKGROUND OF THE INVENTION

This application relates generally to gas turbine engine assemblies and more particularly, to turbine rotor blade airfoil profiles.

In the design, fabrication, and use of turbofan engine assemblies, there has been an increasing tendency towards operating with higher temperatures and higher pressures to optimize turbine performance. In addition, as existing turbine rotor blade airfoils reach the end of their useful life cycle, replacement of the airfoils with redesigned airfoils is often necessary to accommodate the higher temperatures and higher pressures. Moreover, airfoil redesign is desirable without altering or changing other parts of the turbofan engine assemblies.

At least some known rotor blade airfoils are exposed to hot combustion gases. For example, some known turbofan engine assemblies include a combustor that is upstream of a high-pressure turbine. Combustion gases discharged from the combustor flow past the rotor blades. As a result of their exposure to hot combustion gases, such blades may be subjected to high stress and high temperatures caused by thermal gradients and mechanical loadings in the blades. Over time, because of continued exposure to the combustion gases, such blades may bow, creep, and/or crack thereby reducing the operating performance of the engine.

During the design process, the shape of each rotor blade airfoil, as defined by the camber length, chord length, leading edge incident angle, trailing edge exit angle, and trailing edge thickness is variably selected to produce an optimized airfoil design based on the design constraints of the turbofan engine assembly in which the blades are employed. Optimally, the rotor blade airfoil is designed to provide peak performance without sacrificing the aeromechanical integrity of the rotor blade. Often, the design constraints require balancing. For example, longer airfoil chord lengths may negatively impact the life of rotor blades by moving natural frequencies of the blades into an operating range of the turbofan engine assembly at selected operating speeds as compared to shorter airfoil chord lengths. However, in contrast, shorter rotor blade chord lengths may negatively impact performance of the high-pressure turbine as compared to longer airfoil chord lengths.

In addition, other operating constraints may affect the design process. For example, at least some known high-pressure turbine rotor blades are subjected to natural frequency modes that may cause blade damage. More specifically, such frequency modes may cause the high-pressure turbine rotor blades to resonate which may cause cracking, trailing edge deterioration, corner loss, downstream damage, performance losses, reduced time on wing, and/or high warranty costs. In particular, some of such rotor blades may be especially prone to overall aerodynamic loss and high strains in blade regions at 20-30% span near trailing edge regions.

BRIEF DESCRIPTION OF THE INVENTION

In one aspect, an airfoil for a rotor blade including an uncoated profile substantially in accordance with Cartesian coordinate values of X, Y and Z as set forth in Table I is provided. The profile is carried only to four decimal places, wherein Y represents a distance from a platform on which the airfoil is mounted, and X and Z are coordinates defining the profile at each distance Y from the platform.

In another aspect, a high-pressure turbine is provided. The high-pressure turbine includes at least one row of rotor blades. Each of the rotor blades includes a platform and an airfoil extending therefrom. At least one of the airfoils includes an airfoil shape having a nominal profile substantially in accordance with Cartesian coordinate values of X, Y and Z set forth in Table I carried only to four decimal places. Y represents a distance from an upper surface of the platform, and X and Z are coordinates defining the profile at each distance Y from the platform.

In another aspect, a rotor assembly is provided. The rotor assembly includes at least one rotor blade including a platform and an airfoil extending from the platform. The airfoil includes an uncoated profile substantially in accordance with Cartesian coordinate values of X, Y and Z as set forth in Table I carried only to four decimal places. Y represents a distance from an upper surface of the platform, and X and Z are coordinates defining the profile at each distance Y from the platform. The profile is scalable by a predetermined constant n and manufacturable to a predetermined manufacturing tolerance.

DETAILED DESCRIPTION OF THE INVENTION

The exemplary rotor blade profiles described herein overcome the disadvantages of known rotor blade profiles by substantially tailoring the entire trailing edge profile.

Figure 1:
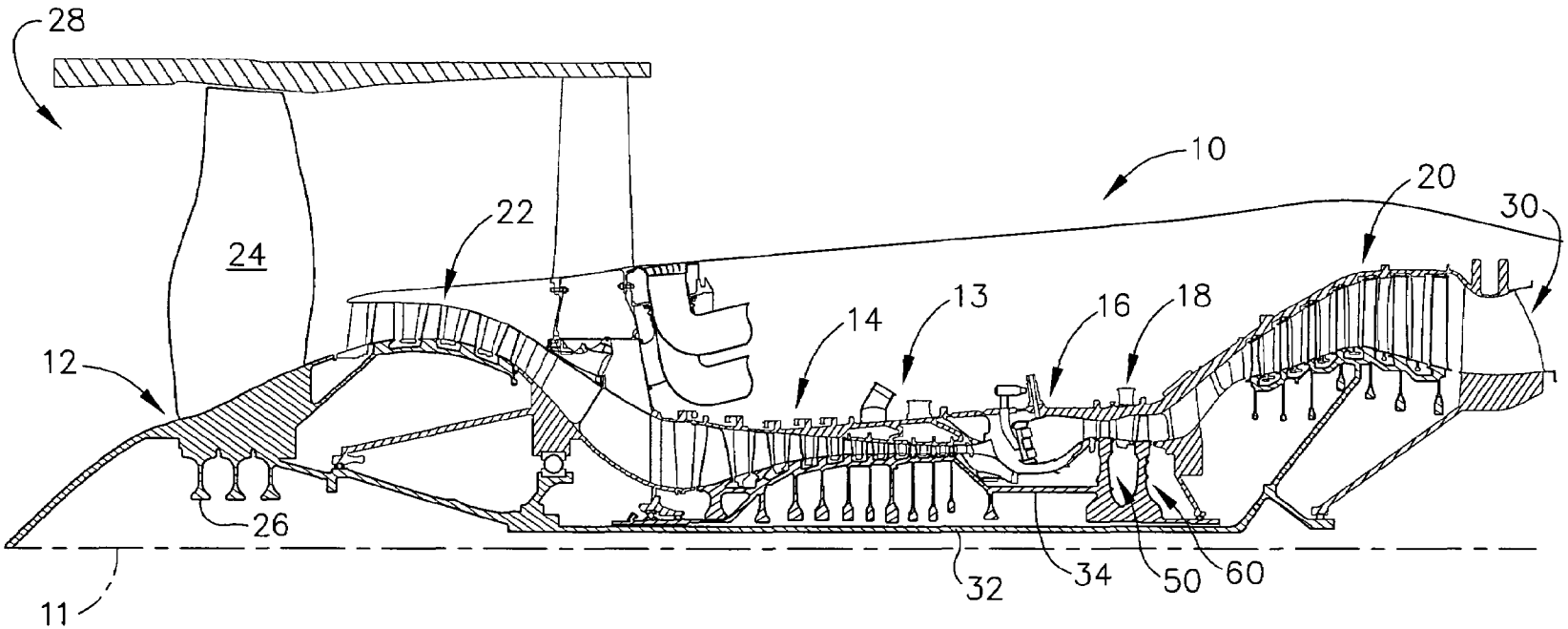
FIG. 1 is a cross-sectional view of a portion of an exemplary turbofan engine assembly.

FIG. 1 is a cross-sectional view of a portion of an exemplary turbofan engine assembly 10 having a longitudinal axis 11. In the exemplary embodiment, turbofan engine assembly 10 includes a fan assembly 12, a core gas turbine engine 13 that is downstream from fan assembly 12, and a low-pressure turbine 20 that is downstream from core gas turbine engine 13. Core gas turbine engine 13 includes a high-pressure compressor 14, a combustor 16, and a high-pressure turbine 18. In the exemplary embodiment, turbofan engine assembly 10 also includes a multi-stage booster compressor 22. Fan assembly 12 includes an array of fan blades 24 that extends radially outward from a rotor disk 26. Turbofan engine assembly 10 has an intake side 28 and an exhaust side 30. Moreover, turbofan engine assembly 10 includes a first rotor shaft 32 coupled between fan assembly 12 and low-pressure turbine 20, and a second rotor shaft 34 coupled between high-pressure compressor 14 and high-pressure turbine 18 such that fan assembly 12, booster 22, high-pressure compressor 14, high-pressure turbine 18, and low-pressure turbine 20 are in serial flow communication and co-axially aligned with respect to longitudinal axis 11 of turbofan engine assembly 10.

During operation, air enters through intake side 28 and flows through fan assembly 12 to booster 22, which discharges air that is channeled to high-pressure compressor 14. Airflow is further compressed in the compressor 14 and delivered to combustor 16, which discharges higher temperature combustion gases (not shown in FIG. 1) that are utilized to drive turbines 18 and 20. Low-pressure turbine 20 is utilized to drive fan assembly 12 and booster 22. In one embodiment, turbofan engine assembly 10 is a GP7200 engine available from Engine Alliance LLC, East Hartford, Conn.

Figure 2:
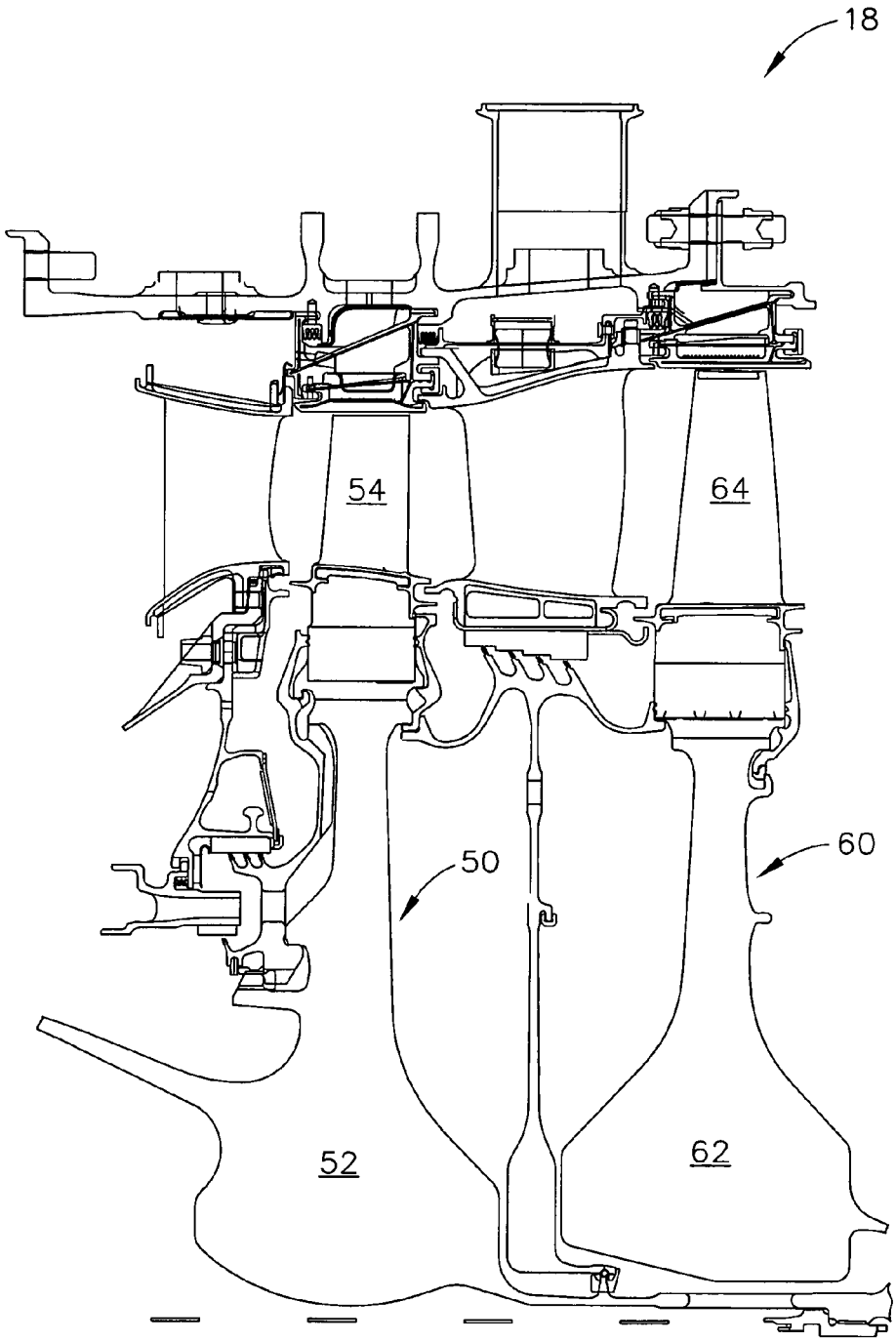
FIG. 2 is an enlarged cross-sectional view of a portion of the engine assembly shown in FIG. 1.

FIG. 2 is a cross-sectional view of high-pressure turbine 18. In the exemplary embodiment, turbine 18 is a two-stage turbine that includes a first stage 50, and a second stage 60. First stage 50 includes a rotor disk 52 and a plurality of blades 54 that are coupled to and extend outward from rotor disk 52. Second stage 60 includes a rotor disk 62, and a plurality of rotor blades 64 that are coupled to and extend outward from rotor disk 62.

Figure 3:
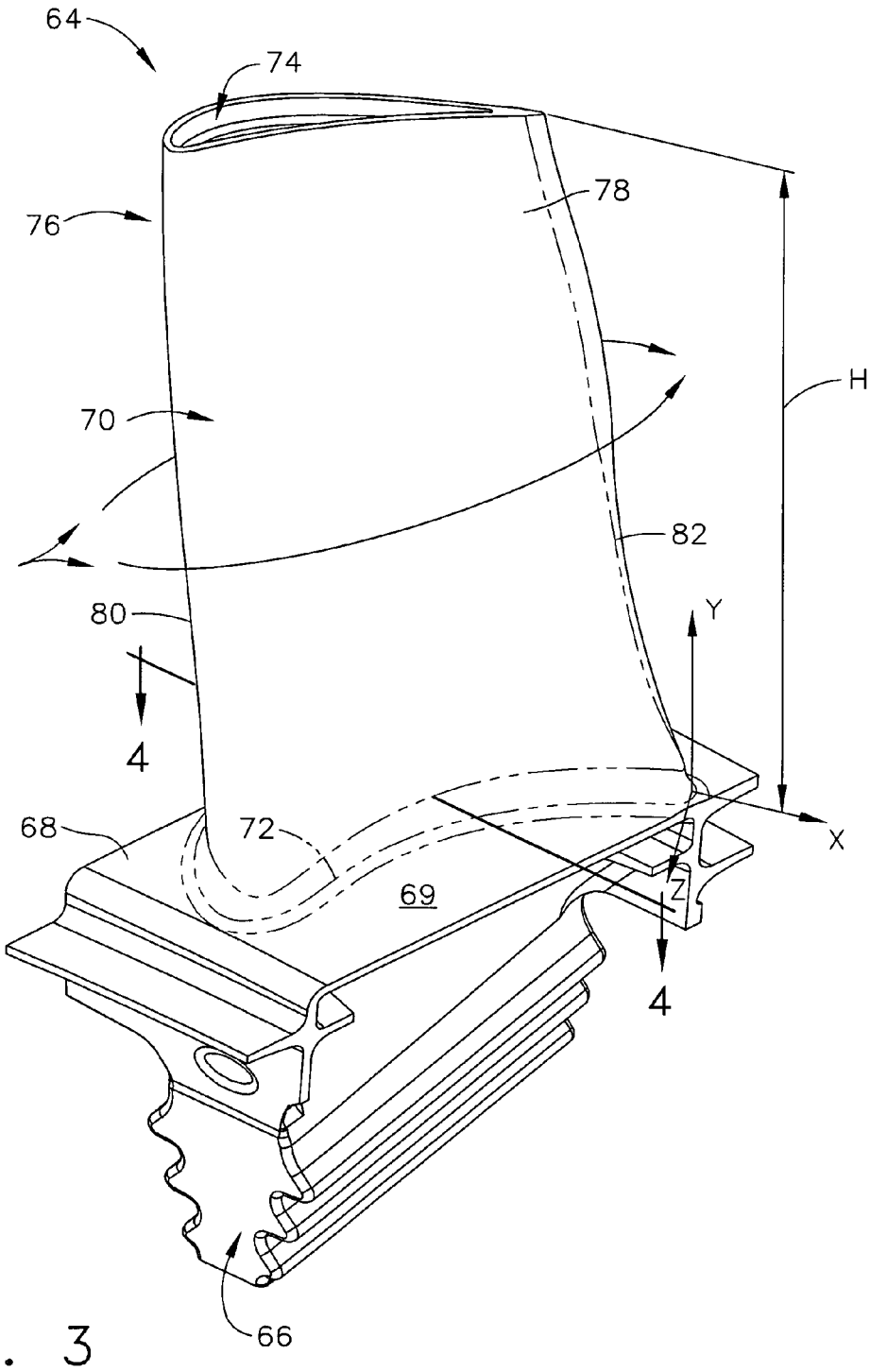
FIG. 3 is an enlarged perspective view of an exemplary rotor blade used with the engine assembly shown in FIG. 1.

FIG. 3 is an enlarged perspective view of rotor blade 64. More specifically, in the exemplary embodiment, rotor blade 64 is coupled within a turbine, such as high-pressure turbine 18 (shown in FIGS. 1 and 2) and forms a portion of a second stage of a turbine, such as stage 60 (shown in FIGS. 1 and 2). As will be appreciated by one of ordinary skill in the art, the rotor blade described herein may be used with other rotary member applications known in the art. The description herein is therefore set forth for illustrative purposes only and is not intended to limit application of the invention to a particular rotor blade, turbine, rotor assembly, or other engine component.

The rotor blade airfoil profile of the present invention, as described below, is believed to be optimal in the second stage of high-pressure turbine 18 to achieve desired interaction between other stages in high-pressure turbine 18, improve aerodynamic efficiency of high-pressure turbine 18, and to optimize aerodynamic and mechanical loading of each rotor blade 64 during turbine operation.

When assembled within turbofan engine assembly 10, each rotor blade 64 extends circumferentially around longitudinal axis 11 (shown in FIG. 1). As is known in the art, when fully assembled, each circumferential row of rotor blades 64 is oriented to channel fluid flow through turbofan engine assembly 10 in such a manner as to facilitate enhancing engine performance. In the exemplary embodiment, circumferentially-adjacent rotor blades 64 are identical and each extends radially across a flow path defined within turbofan engine assembly 10. Moreover, in the exemplary embodiment, each rotor blade 64 extends radially outward from a dovetail 66 and is formed integrally with a base or platform 68.

In the exemplary embodiment, each rotor blade 64 includes an airfoil 70 coupled to dovetail 66 via platform 68. Dovetail 66, platform 68, and/or airfoil may be formed integrally or as separate parts. Airfoil 70 includes a root 72, a tip 74, a suction side 76, a pressure side 78, a leading edge 80, and a trailing edge 82. Suction and pressure sides 76 and 78 are connected at airfoil leading and trailing edges 80 and 82, and span radially between airfoil root 72 and the tip 74.

Figure 4:
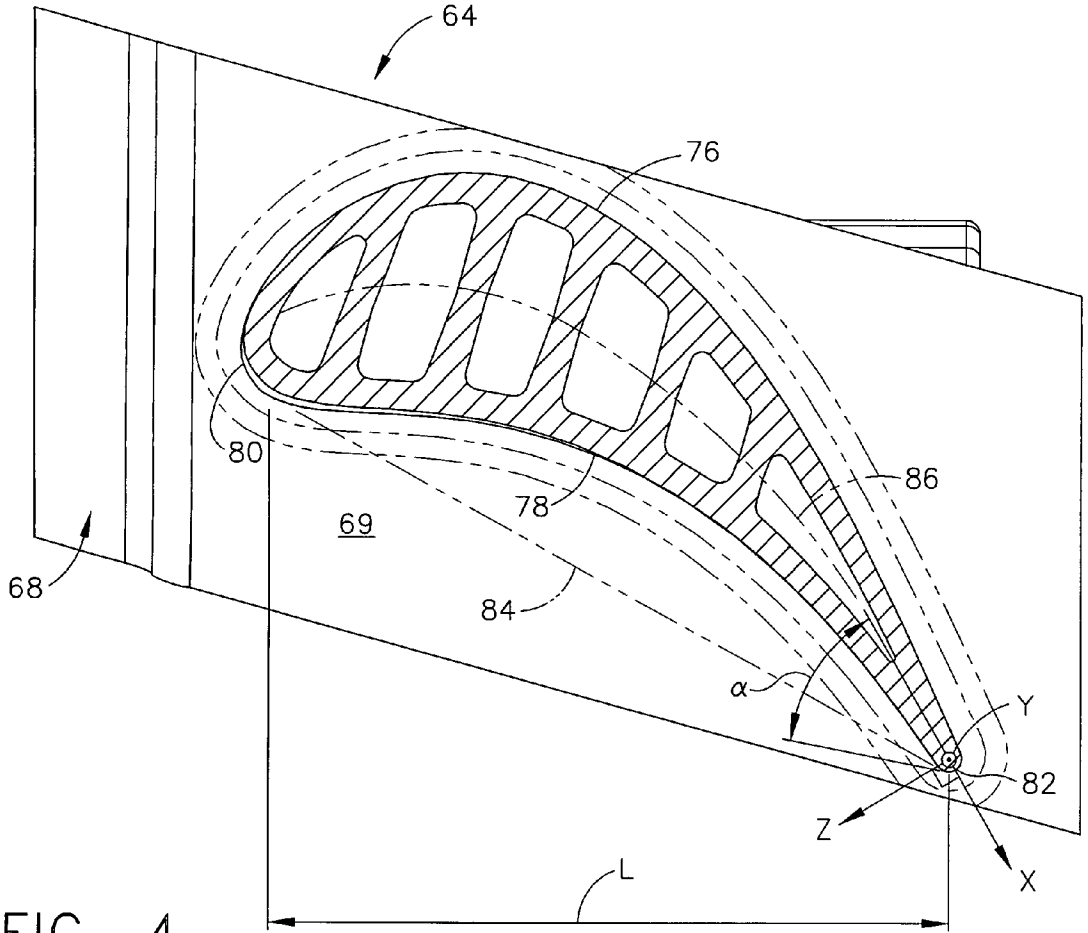
FIG. 4 is a cross-sectional view of the rotor blade shown in FIG. 3 taken along line 4-4.

FIG. 4 is an enlarged cross-sectional view of rotor blade 64 taken along line 4-4 FIG. 3. In the exemplary embodiment, a chord 84 of airfoil 70 has a length L measured from leading edge 80 to trailing edge 82. More specifically, airfoil trailing edge 82 is spaced chord-wise and downstream from airfoil leading edge 80. In the exemplary embodiment, chord length L varies from blade root 72 to blade tip 74.

In the exemplary embodiment, airfoil 70 also includes a mean camber line 86 that extends from blade trailing edge 82 to blade leading edge 80. A shape of camber line 86 is substantially identical from blade root 72 to blade tip 74. Because of the shape of mean camber line 86, a chord length L at blade tip 74 facilitates optimizing a swirl angle of air discharged towards a turbine center frame (not shown) and facilitates reducing pressure losses in the turbine center frame. Moreover, the axial chord length L, true chord 84, and angle $\alpha$ at each span wise location have been optimized to balance the requirements of blade frequency, aerodynamic turning, and trailing edge thickness of trailing edge 82, defined between mean chamber line 86 and line substantially parallel to longitudinal axis 11, the increased chord length L at blade tip 74 facilitates reducing a thickness of trailing edge 82 and reducing exit air obstructions at trailing edge 82.

Figure 5:
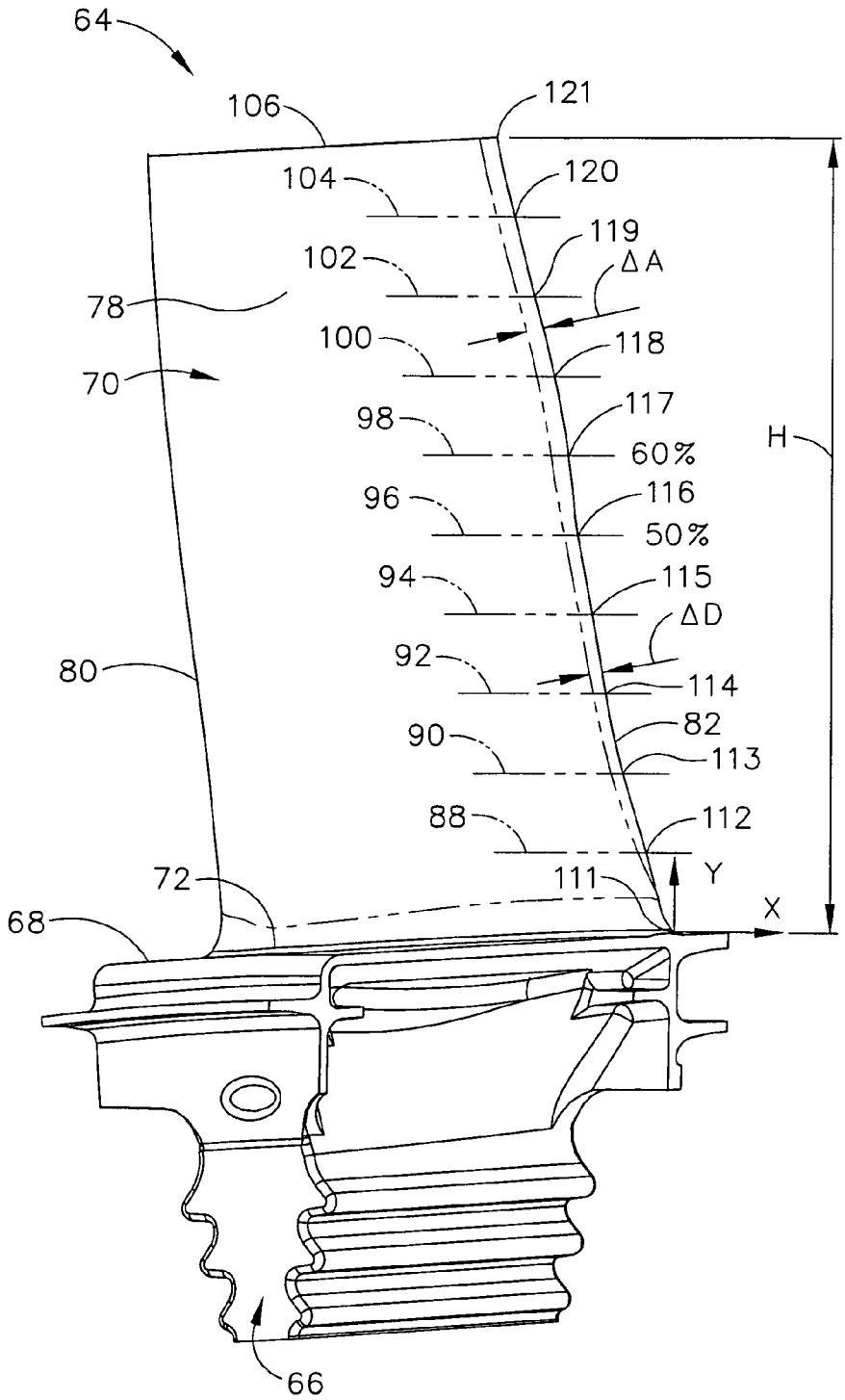
FIG. 5 is another perspective view of the rotor blade shown in FIG. 3.

FIG. 5 is a perspective view of rotor blade 64. In the exemplary embodiment, a total span or height H of rotor blade 64 is divided by a plurality of section lines 88, 90, 92, 94, 96, 98, 100, 102, 104, and 106. Each section line 88, 90, 92, 94, 96, 98, 100, 102, 104, and 106 represents a specified percent of total blade height H as measured from the intersection of platform 68 and airfoil 70 along the Y-axis. In the exemplary embodiment, as is shown in the art, the X-axis extends substantially parallel to an upper surface 69 of platform 68, and the Y-axis extends perpendicular from the X-axis. For example, in the exemplary embodiment, one section line 96 represents a blade span that is approximately fifty percent of total blade span/height H, and another section line 98 represents a blade span that is 60 percent of total blade height H. Therefore, each section line 88, 90, 92, 94, 96, 98, 100, 102, 104, and 106 respectively represents blade spans of approximately ten percent of total blade height H. At each section line/blade height H, a corresponding trailing edge point may be defined with respect to a coordinate system as described in greater detail below.

Via development of source codes, models and design practices, a loci of 1456 points in space that meet the unique demands of the second stage requirements of high-pressure turbine 18 has been determined in an iterative process considering aerodynamic loading and mechanical loading of the blades under applicable operating parameters. The loci of points is believed to achieve a desired interaction between other stages in the high-pressure turbine, aerodynamic efficiency of the high-pressure turbine, and optimal aerodynamic and mechanical loading of the rotor blades during high-pressure turbine operation. Additionally, the loci of points provide a manufacturable airfoil profile for fabrication of the rotor blades, and allow the high-pressure turbine to run in an efficient, safe and smooth manner.

Referring to FIGS. 3-5, there are shown a Cartesian coordinate system for X, Y and Z values set forth in Table I. The Cartesian coordinate system has orthogonally related X, Y and Z axes with the Y-axis or datum lying substantially perpendicular to platform 68 and extending generally in a radial direction through airfoil 70. By defining X and Z coordinate values at selected locations in the radial direction, i.e., in a Y direction, the profile of airfoil 70 can be ascertained. By connecting the X and Z values with smooth continuing arcs, each profile section at each radial distance Y is fixed. The surface profiles at the various surface locations between the radial distances Y can be ascertained by connecting adjacent profiles. Although the X, Y, and Z axes are oriented in the above fashion, it should be appreciated that the X, Y, and Z axes may have any orientation provided that the axes are orthogonally oriented with respect to each other and one axis extends along a height of the blade.

The X and Z coordinates for determining the airfoil section profile at each radial location or airfoil height Y are provided in the following table, wherein Y represents a non-dimensionalized value equal to zero (0) at the upper surface of the platform 68 and that is substantially equal to a value greater than 3.2129 at airfoil tip portion 74. Tabular values for X, Y, and Z coordinates are provided in inches, and represent actual airfoil profiles at ambient, non-operating or non-hot conditions for an uncoated airfoil, the coatings for which are described below. Additionally, the sign convention assigns a positive value to the value Y and negative values for the coordinates X and Z, as typically used in a Cartesian coordinate system.

Table I values are computer-generated and shown to four decimal places. However, in view of manufacturing constraints, actual values useful for forming the airfoil are considered valid to only four decimal places for determining the profile of the airfoil. Further, there are typical manufacturing tolerances which must be accounted for in the profile of the airfoil. Accordingly, the values for the profile given in Table I are for a nominal airfoil. It will therefore be appreciated that plus or minus typical manufacturing tolerances are applicable to these X, Y and Z values and that an airfoil having a profile substantially in accordance with those values includes such tolerances. For example, a manufacturing tolerance of about ±0.020 inches is within design limits for the airfoil. Thus, the mechanical and aerodynamic function of the airfoils is not impaired by manufacturing imperfections and tolerances, which in different embodiments may be greater or lesser than the values set forth above. As appreciated by those in the art, manufacturing tolerances may be determined to achieve a desired mean and standard deviation of manufactured airfoils in relation to the ideal airfoil profile points set forth in Table I.

In addition, and as noted previously, the airfoil may also be coated for protection against corrosion and oxidation after the airfoil is manufactured, according to the values of Table I and within the tolerances explained above. In an exemplary embodiment, an anti-corrosion coating or coatings is provided with a total average thickness of about 0.001 inches. Consequently, in addition to the manufacturing tolerances for the X and Y values set forth in Table I, there is also an addition to those values to account for the coating thicknesses. It is contemplated that greater or lesser coating thickness values may be employed in alternative embodiments of the invention.

As the second stage rotor blade assembly, including the aforementioned airfoils, heats up during operation, applied stresses and temperatures induced to on the turbine blades may inevitably cause some deformation of the airfoil shape, and hence there is some change or displacement in the X, Y and Z coordinates set forth in Table I as the engine is operated. While it is not possible to measure the changes in the airfoil coordinates in operation, it has been determined that the loci of points set forth in Table I, plus the deformation in use, enables the high-pressure turbine to run in an efficient, safe and smooth manner.

It is appreciated that the airfoil profile set forth in Table I may be scaled up or down geometrically in order to be introduced into other similar machine designs. It is therefore contemplated that a scaled version of the airfoil profile set forth in Table I may be obtained by multiplying or dividing each of the X and Y coordinate values by a predetermined constant n. It is should be appreciated that Table I could be considered a scaled profile with n set equal to 1, and greater or lesser dimensioned airfoils could be obtained by adjusting n to values greater and lesser than 1, respectively.

It should be also be appreciated that Table 1 shows eleven point locations 111-121 to define a contour of trailing edge 82. The other points defining trailing edge 82 may be interpolated based on point locations 111-121. More specifically, point locations 111-121 have been determined to define a contour of trailing edge 82 such that respective chord lengths of airfoil 70 facilitate balancing overall performance and durability of blade 64.

The above-described exemplary rotor blade airfoil profiles facilitate minimal impact to the natural frequencies of the blades and high strain areas of the blades. Moreover, above-described exemplary rotor blade airfoil profiles facilitate recovery of aerodynamic loss as compared to known rotor blade airfoil profiles. Therefore, the above-described exemplary rotor blades provide a cost-effective and reliable method for optimizing performance of a turbofan engine assembly. More specifically, each rotor blade airfoil has an airfoil shape that facilitates achieving a desired interaction between other stages in the high-pressure turbine, aerodynamic efficiency of the high-pressure turbine, and optimal aerodynamic and mechanical loading of the rotor blades during high-pressure turbine 18 operation. As a result, the defined airfoil geometry facilitates extending a useful life of the turbofan engine assembly and improving the operating efficiency of the high-pressure turbine in a cost-effective and reliable manner.

Exemplary embodiments of rotor blades and rotor assemblies are described above in detail. The rotor blades are not limited to the specific embodiments described herein, but rather, components of each rotor blade may be utilized independently and separately from other components described herein. For example, each rotor blade trailing edge can also be defined in, or used in combination with, other rotor blades or with other rotor assemblies, and is not limited to practice with only rotor blade 64 as described herein. Rather, the present invention can be implemented and utilized in connection with many other blade and rotor configurations.

Table I below shows coordinates of various trailing edge point locations that define an exemplary airfoil trailing edge profile.

| Point | X | Y | Z |
|---|---|---|---|
| 111 | 0.0000 | 0.0000 | 0.0000 |
| 112 | −0.0954 | 0.3288 | −0.0109 |
| 113 | −0.1993 | 0.6418 | −0.0205 |
| 114 | −0.2705 | 0.9563 | −0.0304 |
| 115 | −0.3259 | 1.2727 | −0.0407 |
| 116 | −0.3797 | 1.5882 | −0.0510 |
| 117 | −0.4341 | 1.9037 | −0.0615 |
| 118 | −0.4829 | 2.2194 | −0.0726 |
| 119 | −0.5553 | 2.5339 | −0.0831 |
| 120 | −0.6354 | 2.8490 | −0.0933 |
| 121 | −0.7200 | 3.2129 | −0.1057 |

While the invention has been described in terms of various specific embodiments, those skilled in the art will recognize that the invention can be practiced with modification within the spirit and scope of the claims.

What is claimed is:

1. An airfoil for a rotor blade comprising an uncoated profile substantially in accordance with Cartesian coordinate values of X, Y and Z as set forth in Table I and carried only to four decimal places, wherein Y is a distance from a platform on which the airfoil is mounted, and X and Z are coordinates defining the profile at each distance Y from said platform.

2. An airfoil in accordance with claim 1 wherein said airfoil comprises a second stage of a high-pressure turbine.

3. An airfoil in accordance with claim 1 wherein said airfoil profile lies in an envelope within +/−0.020 inches in a direction normal to any airfoil surface location.

4. An airfoil in accordance with claim 1 wherein said airfoil profile defines a contour of a trailing edge of said airfoil to facilitate improving an operating efficiency of said high-pressure turbine.

5. An airfoil in accordance with claim 1 wherein a trailing edge of said airfoil is tapered from a tip of said airfoil to a root of said airfoil.

6. A high-pressure turbine comprising at least one row of rotor blades, each of said rotor blades comprises a platform and an airfoil extending therefrom, at least one of said airfoils comprises an airfoil shape having a nominal profile substantially in accordance with Cartesian coordinate values of X, Y and Z set forth in Table I carried only to four decimal places, wherein Y represents a distance from an upper surface of said platform, and X and Z are coordinates defining the profile at each distance Y from said platform.

7. A high-pressure turbine in accordance with claim 6 wherein each said airfoil shape is defined by the profile sections at the Y distances being connected to one another by a continuing arc to form a complete airfoil shape.

8. A high-pressure turbine in accordance with claim 6 wherein said at least one airfoil further comprises a coating extending over at least a portion of said at least one airfoil, said coating comprising a thickness of about 0.001 inches or less.

9. A high-pressure turbine in accordance with claim 6 wherein said at least one row of rotor blades comprises a second stage of said high-pressure turbine.

10. A high-pressure turbine in accordance with claim 6 wherein said airfoil profile lies in an envelope within +/−0.020 inches in a direction normal to any airfoil surface location.

11. A high-pressure turbine in accordance with claim 6 wherein said airfoil profile defines a contour of a trailing edge of said airfoil to facilitate improving an operating efficiency of said high-pressure turbine.

12. A high-pressure turbine in accordance with claim 6 wherein a trailing edge of said airfoil is tapered from a tip to a root.

13. A high-pressure turbine in accordance with claim 6 wherein said airfoil shape facilitates optimizing an aerodynamic efficiency of said airfoil.

14. A rotor assembly comprising at least one rotor blade comprising a platform and an airfoil extending from said platform, said airfoil comprises an uncoated profile substantially in accordance with Cartesian coordinate values of X, Y and Z as set forth in Table I carried only to four decimal places, wherein Y represents a distance from an upper surface of said platform, and X and Z are coordinates defining the profile at each distance Y from said platform, said profile scalable by a predetermined constant n and manufacturable to a predetermined manufacturing tolerance.

15. A rotor assembly in accordance with claim 14 wherein said predetermined manufacturing tolerance is about ±0.020 inches.

16. A rotor assembly in accordance with claim 14 wherein said rotor assembly forms a portion of a high-pressure turbine, said rotor assembly comprises a portion of a second stage of the high-pressure turbine.

17. A rotor assembly in accordance with claim 14 further comprising a coating upon said airfoil, said coating having a thickness of about 0.001 inches or less.

18. A rotor assembly in accordance with claim 14 wherein said airfoil profile defines a contour of a trailing edge of said airfoil to facilitate improving an operating efficiency of said high-pressure turbine.

19. A rotor assembly in accordance with claim 14 wherein said airfoil profile facilitates optimizing an aerodynamic efficiency of said airfoil.

20. A rotor assembly in accordance with claim 14 wherein a trailing edge of said airfoil is tapered from a tip to a root.

* * * * *